US007421814B2

(12) United States Patent
Peles

(10) Patent No.: US 7,421,814 B2
(45) Date of Patent: Sep. 9, 2008

(54) SAFETY MECHANISM FOR HANDGUN AND RIFLE TRIGGER

(76) Inventor: Zalman Peles, Cfar Corazim, M.P., Corazim 12391 (IL)

( * ) Notice: Subject to any disclaimer, the term of this patent is extended or adjusted under 35 U.S.C. 154(b) by 360 days.

(21) Appl. No.: 11/019,308

(22) Filed: Dec. 23, 2004

(65) Prior Publication Data

US 2006/0005444 A1 Jan. 12, 2006

Related U.S. Application Data

(60) Provisional application No. 60/555,062, filed on Jul. 6, 2004.

(51) Int. Cl.
*F41A 17/54* (2006.01)

(52) U.S. Cl. ..... 42/70.07

(58) Field of Classification Search ..... 42/70.06, 42/70.07

See application file for complete search history.

(56) References Cited

U.S. PATENT DOCUMENTS

| | | | | |
|---|---|---|---|---|
| 467,524 | A * | 1/1892 | Storer | 42/20 |
| 749,877 | A * | 1/1904 | Neuber et al. | 42/41 |
| 846,591 | A * | 3/1907 | Mason | 89/145 |
| 1,296,088 | A * | 3/1919 | Jones | 200/512 |
| 4,813,252 | A | 3/1989 | Ray | |
| 5,191,158 | A | 3/1993 | Fuller et al. | |
| 5,361,526 | A | 11/1994 | Campbell | |
| 5,367,811 | A | 11/1994 | Sansom | |

* cited by examiner

*Primary Examiner*—Stephen M Johnson
(74) *Attorney, Agent, or Firm*—AlphaPatent Associates Ltd.; Daniel J. Swirsky

(57) ABSTRACT

A safety mechanism for handgun useful for preventing shooting by toddlers, having a lock ring assembly, having means to match the trigger finger of adults only, and a box assembly, having means to enable the shooting exclusively performed by said adults.

15 Claims, 7 Drawing Sheets

SAFETY MECHANISM FOR HANDGUN AND RIFLE TRIGGER

This application claims the benefit of provisional U.S. application 60/555,062, filed on Jul. 6, 2004.

FIELD OF THE INVENTION

The present invention relates generally to the field of handgun safety. More specifically, the present invention relates to a safety mechanism for rendering the trigger of a handgun inoperative by a child.

BACKGROUND OF THE INVENTION

In the United States alone, there are 200 million privately owned small firearms. It is estimated that every seven minutes, a death is caused by a child who gains access to a firearm belonging to his parents or to another adult. This is because the child believes the firearm to be a toy, or simply does not know the dangers involved in handling the firearm. The problem is especially prevalent with toddlers 6 to 14 years of age. Parents often hide loaded firearms in their homes in places where they do not believe children will find them, but the location of the handgun often becomes known and the child is severely injured or killed playing with it.

This situation has led to the development of a variety of different safety devices and mechanisms that are designed for preventing unauthorized or unintentional use of a handgun or other firearm. Some devices employ trigger or barrel locks, which require removal or deactivation of the lock prior to shooting of the firearm. Others work on the basis of electronic locking systems that recognize, and thus only allow operation by an authorized user. Another way to prevent unauthorized access to a firearm, which is commonly used, is to lock the firearm (and the ammunition) in a safe or locked closet or drawer.

The following patents are hereby incorporated by reference and are meant to serve as examples of the prior art in the field of safety devices or mechanisms for firearms: U.S. Pat. No. 5,367,811 to Sansom relates to a trigger lock device that includes a lock assembly that is positionable between a firearm trigger and a firearm frame within the trigger guard. The lock assembly is arranged so as to discourage access to the firearm by children and the like by providing for ease of access to the firearm by adults comprehending the ease of disengaging the lock structure. U.S. Pat. No. 4,813,252 to Ray relates to a locking device for firearms which prevents firearms from being removed by children from the walls from which they are being displayed. U.S. Pat. No. 5,361,526 to Campbell relates to a child resistant quick release firearm safety and security device that is inserted into the loading port of a firearm. The device must be freed from the firearm prior to operation of the firearm. U.S. Pat. No. 5,191,158 to Fuller et al. relates to a trigger guard for a firearm. The trigger guard is essentially a clamping mechanism that overlies at least part of the trigger that has do be shifted in order to allow for operation of the trigger. All of the cited patents are hereby incorporated by reference in their entireties.

Further examples of patents which relates to the field of safety devices are U.S. Pat. No. 467,524 (524) to Storer; U.S. Pat. No. 846,591 (591) to mason; and U.S. Pat. No. 1,296,088 (088) to Jones. Patent 524 relates to a safety trigger for breech loading guns. Patent 524 teaches how to prevent an accidental discharge of the gun and injury to the forefinger in restoring the finger-lever to position after cocking the gun by the finger-lever. Patent 524 does not teach a safety mechanism that prevents an accidental discharge by toddlers. Patent 591 relates to an improvement in the class of automatic firearms in which the extraction and ejection of the spent shell, the relocking of the hammer and the loading of a cartridge into the gun-barrel is effected by the breech mechanism acting under the influence of the explosion gases. Patent 088 relates to a finger attachment for signaling devices. In patent 088, a fingertip attachment is disclosed which permits the operator of a car to blow the horn without lifting his hand from the perimeter of the steering wheel to the center of the steering wheel, where the horn is often located. All of the cited patents are hereby incorporated by reference in their entireties.

SUMMARY OF THE INVENTION

It is thus the object of the present invention to provide a safety mechanism for handgun useful, for preventing shooting by toddlers yet to enable a rapid shot by the authorized adult. Said safety mechanism comprising a lock ring assembly, having means to match the trigger finger of adults only, and a box assembly, having means to enable the shooting exclusively performed by said adults.

More specifically, the said safety mechanism according to what has been defined above comprising the above mentioned lock ring assembly having means to match the trigger finger of adults only. This ring assembly is composed of a trigger, which is in communication with the fire mechanism of the handgun; a ring having an inner diameter of 15 to 19 mm, and in particularly 17 mm, adapted to match the width of the trigger finger of an adult squeezing said trigger; and at least one safety latch. In addition, said safety mechanism also comprises of a box assembly, which is especially adapted to accommodate said ring assembly; and which has means to enable the shooting exclusively performed by said adults; a body, having at least one locking element having means to be pressed by said safety latch hence allowing the trigger to move and to facilitate the shot; and a box cover, entrapping the box assembly to the trigger guard.

It is acknowledged that the safety mechanism is adapted to enable the shooting only whenever a trigger finger of an adult is pressing all said safety latches at once, so said safety latches are in communication with all said locking elements.

According to one embodiment of the present invention, the safety mechanism as defined above has a mechanical communication between the latch and locking element. More specifically, said safety mechanism has a mechanical communication between the latch and locking element. This is wherein an axis located in the end of said body of said safety latch has means to swing said latch trough a groove cut in said ring towards said locking element; so whereas all latches are sufficiently twisted towards all lock elements, said locking elements are pressed, enabling the trigger to be squeezed so the shot is facilitated. Most specifically, the aforementioned safety mechanism has two safety latches and two locking elements.

According to another embodiment of the present invention, the safety mechanism defined above has electrical communication between the latch and the locking element, comprising the lock ring assembly, the box assembly and an electronic circuit assembly. More specifically, the electronic circuit assembly comprising a locking servo, locking micro-switches and disposable power supply.

According to another embodiment of the present invention, the safety mechanism as defined above additionally comprising a safety-catch. This safety-catch comprising a lock ring assembly and a box assembly. The lock ring assembly is having a trigger in communication with the fire mechanism of the handgun; a ring having at least one groove cut, designed to accommodate the trigger finger of an adult squeezing said trigger; at least one safety latch yet preferably two said latches and at least one safety-catch connected to said ring by means of an axis having a protruding pin member.

The box assembly is further adapted to accommodate said ring assembly, and has a body having at least one locking element having means to be pressed by said safety latches, allowing hence the trigger to move and to facilitate the shot. Most preferably, two locking elements are useful for said safety mechanism. In addition, said box assembly contains a box cover, having means to entrap the box assembly to the trigger guard; wherein said box assembly is having at least one groove cut adapted to accommodate said pin member in a situation said safety-catch is effectively pressed by means of the digital pulp of the trigger finger. The safety mechanism has further means to enable the shooting only whenever a trigger finger of an adult is pressing all said safety latches and safety-catch at once.

Another object of the present invention is to provide a safety-catch for handgun comprising; a trigger in communication with the fire mechanism of said handgun; a catch having means to swing trough an opening in said trigger; and a trigger guard having a groove, adapted to accommodate said safety latch whenever said trigger is twisted by the digital pulp of the trigger finger.

Thus, according to one preferred embodiment of the present invention, a safety-catch for handgun especially is provided useful to handguns having a safety mechanism adapted to enable the shooting only whenever a trigger finger of an adult is pressing said safety-catch. Said specific safety mechanism comprising: at least one safety-catch connected to the ring by means of an axis having a protruding pin member; and a box cover, having at least one groove adapted to accommodate said pin member in a situation said safety-catch is effectively pressed by means of the digital pulp of the trigger finger;

Moreover, the above mentioned safety mechanism may additionally comprise means to accommodate an external lock and additionally or alternatively, a safety-catch, having a lock ring assembly. Said lock ring assembly comprises a trigger, which is in communication with the fire mechanism of the handgun; a ring having a inner diameter with predetermined width of 15 to 19 mm and particularly 17 mm, designed to accommodate the trigger finger of an adult; and at least one safety latch; a safety-catch being characterized by an elliptical or polygonal shape. Said box assembly adapted to accommodate said ring assembly, having a body comprising at least one locking element; and a box cover, entrapping the lock ring assembly to the trigger guard. This is adapted to enable the shooting only whenever said trigger finger is touching all said safety latches, and side safety latches are in communication with all said locking elements.

Still another object of the present invention is to provide a safe handgun comprising a safety mechanism as defined in any of the embodiments hereafter mentioned.

Last object of the present invention is to provide a useful method to prevent toddlers from shooting a handgun comprising the safety mechanism as defined above. Said method is containing the steps of matching the circumference of the trigger finger to have diameter higher than a value of 15 to 19 mm so in case of toddlers squeezing the trigger, the shot is prohibited, and alternatively, in case adults are using said handgun, shooting is enabled.

According to another embodiment of the present invention, a method is provided especially to prevent shooting of a double action handgun by toddlers, comprising the steps of (i) inserting the trigger finger into the trigger guard of the handgun; (ii) pressing simultaneously all the safety latches by said trigger finger so all the locking elements at effectively pressed; (iii) compressing the mainspring of the handgun by either cocking the hammer or pulling the trigger; (iv) squeezing the trigger by the trigger finger and enabling the shot. Similarly, an embodiment especially adapted to prevent shooting of a single action handgun by toddlers, comprising the steps of (i), compressing the mainspring of the handgun; (ii) inserting the trigger finger into the trigger guard of the handgun; (iii) pressing simultaneously all the safety latches by said trigger finger so all the locking elements at effectively pressed; and (iv) squeezing the trigger by the trigger finger and enabling the shot.

It is in the scope of the present invention to provide a useful method for shooting a handgun comprising a safety-catch. The method comprising step of squeezing the trigger by the digital pulp of the trigger finger so said safety-catch is sufficiently pressed enough inside its groove cut, enabling thus the pin member attached to the axis of said safety-catch to fit inside a groove located either in the trigger guard or in the box cover.

It is still in the scope of the present invention to provide a method to prevent toddlers from shooting a double action handgun having the electrical safety mechanism. Said method comprising the steps of (i) inserting the trigger finger into the trigger guard of the handgun; (ii) pressing simultaneously all the micro-switches by said trigger finger so a servo's electromagnet is pulling a lock tongue which is enabling the trigger to move backwards; (iii) compressing the mainspring of the handgun by either cocking the hammer or pulling the trigger; and (iv) squeezing the trigger by the trigger finger and enabling the shot.

Lastly, the present invention is providing a useful method especially adapted to prevent toddlers from shooting a single action handgun having the electrical safety mechanism, comprising; (i) compressing the mainspring of the handgun; (ii) inserting the trigger finger into the trigger guard of the handgun so a servo's electromagnet is pulling a lock tongue which is enabling the trigger to move backwards; and (iii) squeezing the trigger by the trigger finger.

BRIEF DESCRIPTION OF THE DRAWINGS

FIG. 6 presents the safety mechanism of double action handgun, wherein

DETAILED DESCRIPTION OF THE INVENTION

Figure 1:
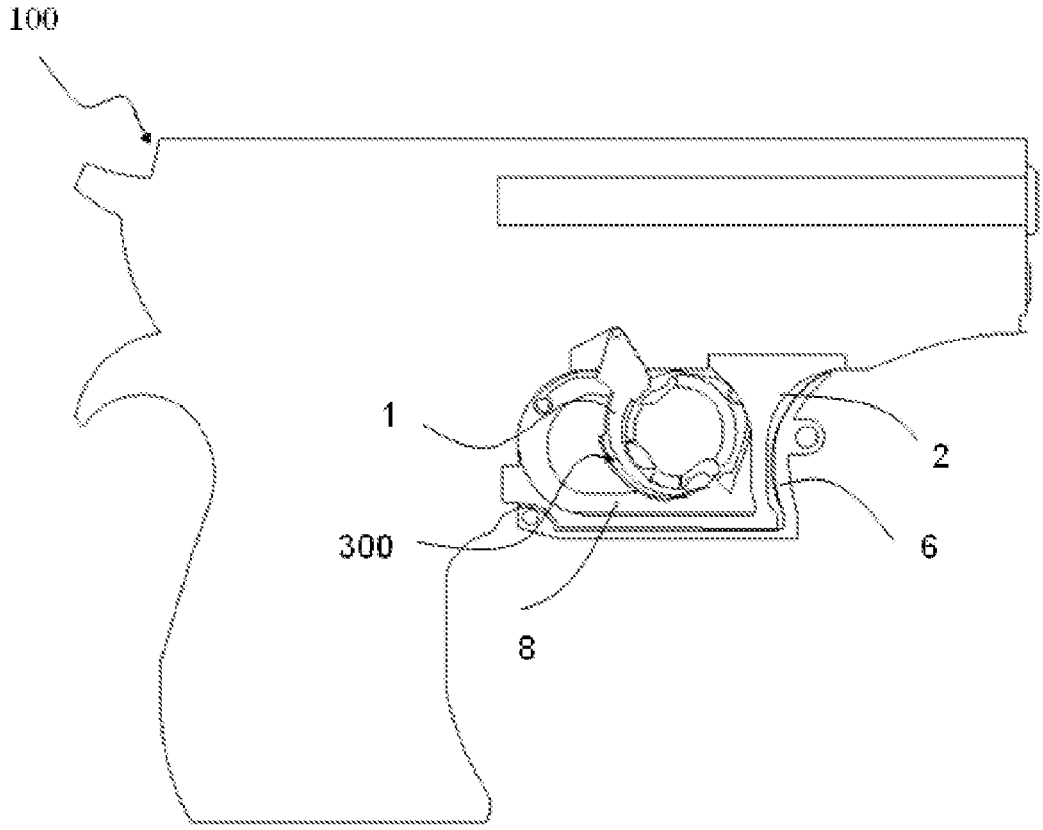
FIG. 1 presents a handgun having the safety mechanism as described in the present invention.
Figure 2:
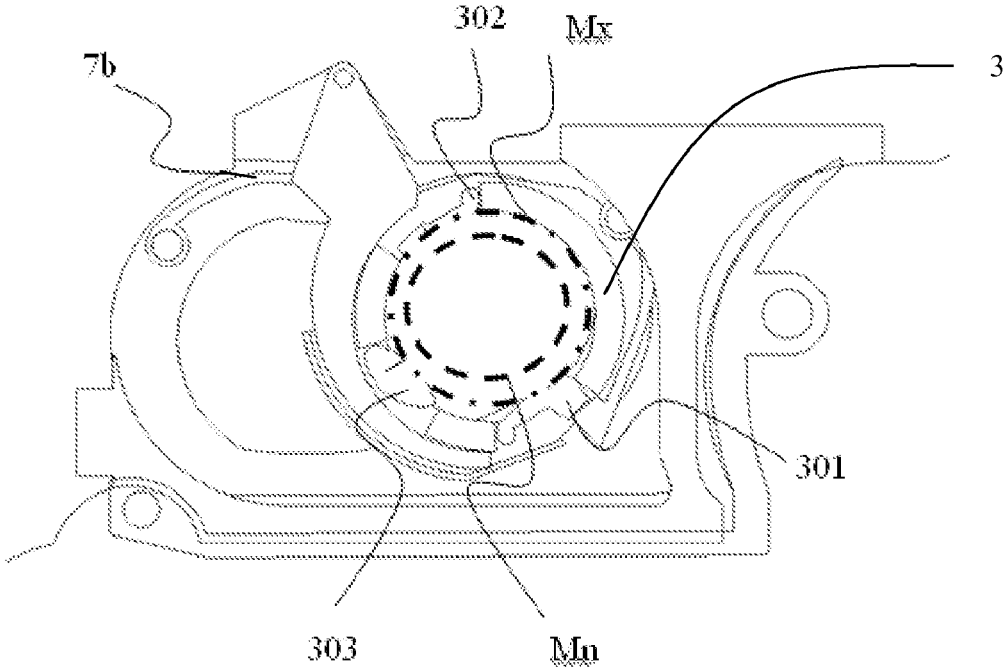
FIGS. 2-4 present the safety mechanism according to the present invention.
Figure 3:
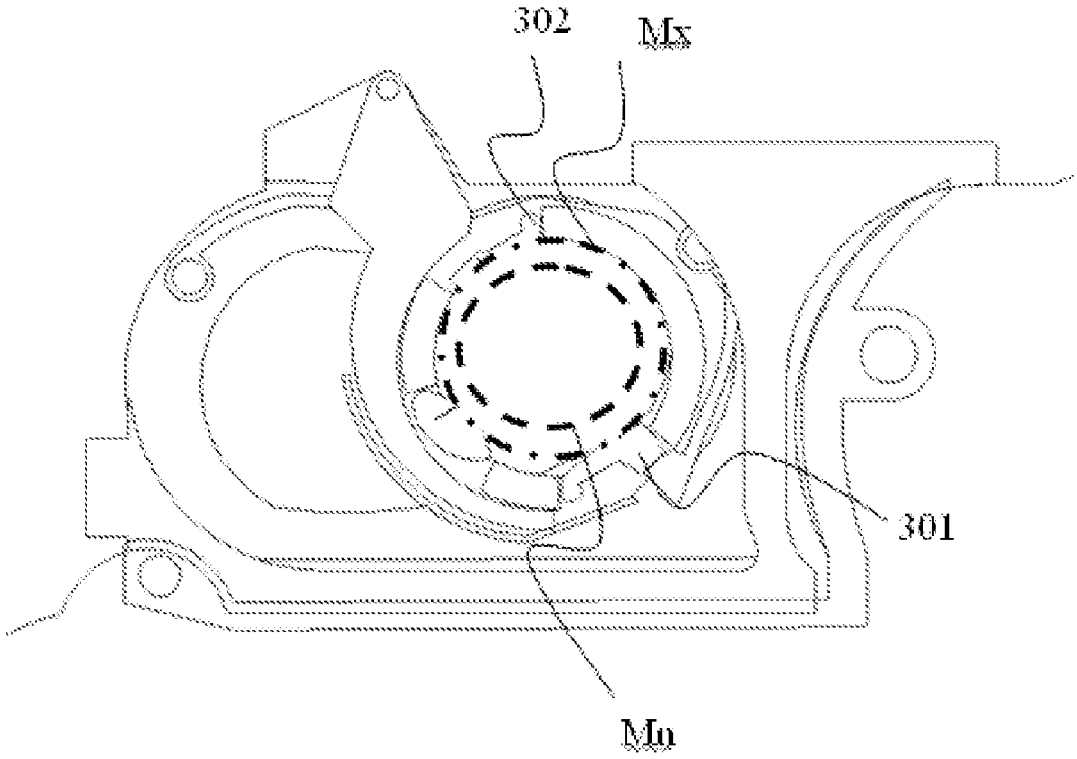
Figure 4:
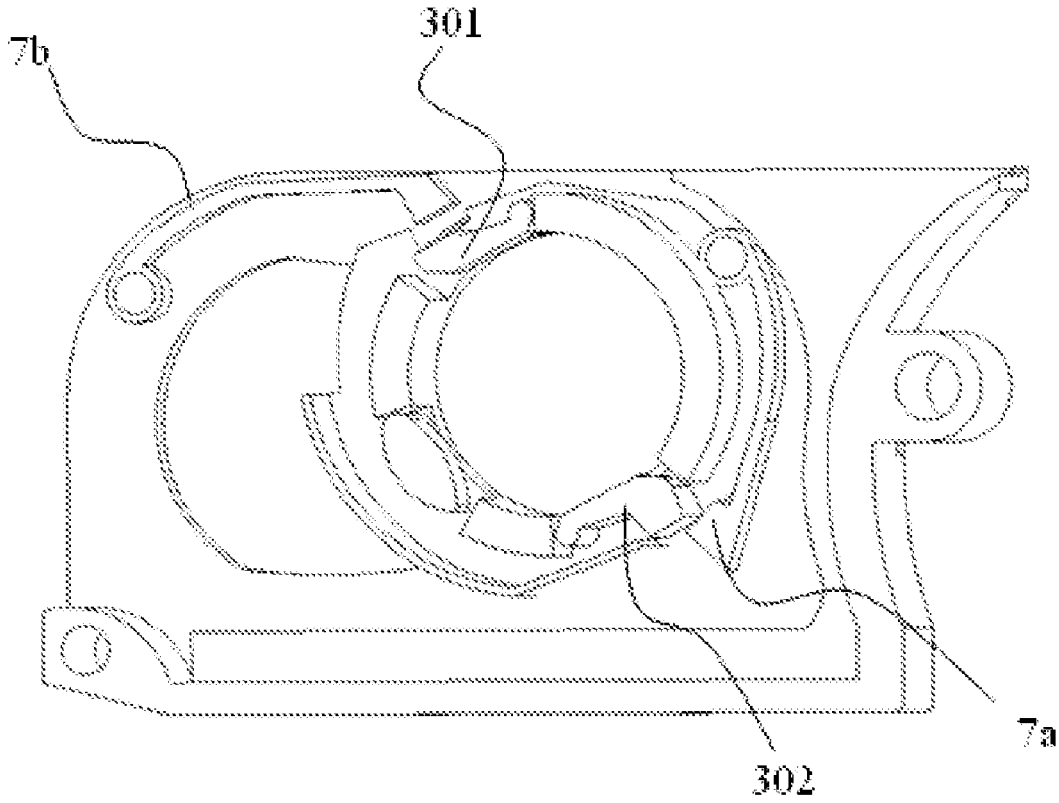
Figure 5:
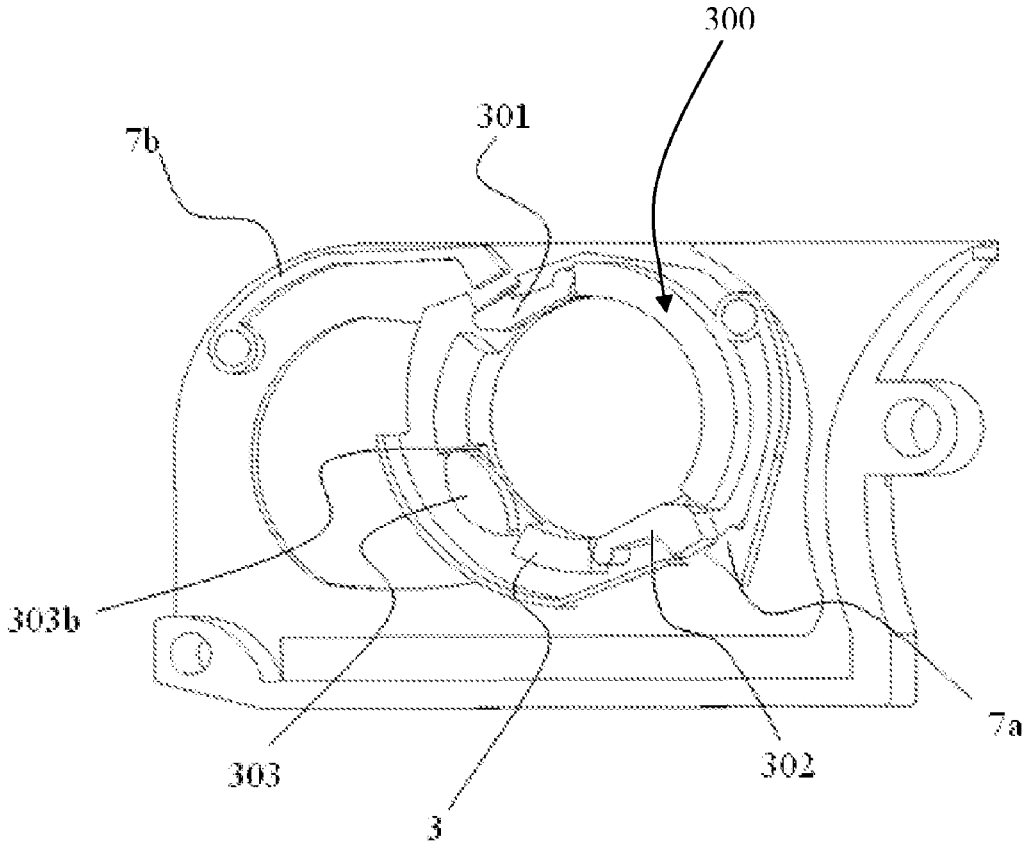
FIG. 5 presents the safety mechanism according to another embodiment of the present invention.

The present invention provides a useful safety mechanism for handguns, designed in a manner such that shooting said handgun by toddlers is prevented. According to the present invention, said safety mechanism comprising a lock ring assembly, having means to measure if the diameter of the trigger finger is greater than a predetermined width and a box assembly, having means to enable the shooting by adults only.

It is in the scope of the present invention, wherein said measuring means are calibrated to about 17 mm, which is the average diameter of the trigger finger of an adult. It is well acknowledged in the present invention that children in the age of 6 to 13 years old, hereto defined in the term 'toddlers', have an average diameter of a trigger finger in the range of 13 to 14 mm. These toddlers are unable to move all the safety latches at once and thus an unauthorized shooting of the handgun by toddlers is prevented.

In the scope of the present invention, the safety mechanism hereto described is thus a hybridization of a Measurement Device with a Pin Lock. The following description is thus provided, along all chapters of the present invention, to enable any person skilled in the art to make use of the invention and sets forth the best modes contemplated by the inventor of carrying out this invention. Various modifications, however, will remain apparent to those skilled in the art, since the generic principles of the present invention have been defined specifically to provide for an improved safety mechanism for handgun useful for preventing shooting said handgun by toddlers.

The term 'handgun' refers hereinafter especially to a pistol or revolver, yet also to any weapon comprising a trigger, and most particularly to non-automatic, semi-automatic or automatic rifled-bore rifles, smooth-bore shotguns, hunting weapons, revolvers having a cylindrical cartridge and magazine containing pistols. The term 'handgun' refers to either single action or double action handguns.

In this respect it is acknowledged that in order to fire a handgun, two specific actions must take place. Step 1: The mainspring must be compressed in order to generate potential energy. This is often done by cocking the hammer. Some handguns, however, do not have hammers, and the mainspring is directly connected to a spring-loaded striker (the firing pin). Step 2: The mainspring must be released, thus converting the stored potential energy to mechanical energy. All handguns (revolvers, semi-automatic pistols, and derringers) must perform those two steps in order to discharge the cartridge. The action of a handgun refers to the mechanism used to perform those steps.

There are three general types of actions commonly used on handguns, each of them performing the two basic steps slightly differently:

Single Action—when the trigger is pulled in a single action handgun, it performs only Step 2—releasing the hammer from its cocked position. In single action handguns, the hammer must be cocked manually (Step 1). It is acknowledged that today, most handguns, for civilian use, require a single action mechanism.

Double Action—when the trigger is pulled in a double action handgun, both Steps 1 and 2 are performed. The hammer is cocked and then released by pulling the trigger. Since the process of cocking the hammer compresses the mainspring, the force that must be applied to the trigger of a double action handgun is greater than that of a single action handgun. The hammer of a double action handgun, however, can be manually cocked.

Double Action Only—these types of handguns function essentially the same way as double action handguns, except for the fact that it is not possible to manually cock the hammer. In the present invention, double action only handguns will be discussed and referred to as double action handguns.

The term 'trigger finger' refers hereinafter in the present invention to the finger squeezing the trigger. Most often, the trigger finger is the pointing finger of the right hand. The trigger finger touches the trigger on one spot, named the digital pulp. It is the core of the present invention, wherein the diameter of said trigger finger is about 17 mm, an indication for adult using the handgun. The term 'digital pulp' refers hereinafter to the fingertip or to the pad of the trigger finger, which enables the trigger to move backwards, and thus provides the handgun with the ability to shoot. Usually, the final step before shooting, also know as 'squeezing the trigger' comprises a gradually upwards concaved movement of said digital pulp along the trigger.

The term 'safety-catch' refers in the present invention specifically to a certain safety latch (303) which is located adjacent to the trigger, having gradually elliptical or polygonal shape. The safety-catch has at least one groove cut (303*b*, see FIGS. 6*a*, 6*b*), designed to accommodate the trigger finger of an adult squeezing the trigger. The safety catch is connected to the ring (3) by a protruding pin member (303*a*, see FIGS. 6*a*, 6*b*). The groove cut (303*b*) is adapted to accommodate said pin member (303*a*) in a situation said safety-catch is effectively pressed by means of the digital pulp of the trigger finger. The safety-catch has a protruding axis in which the pin member (303*a*) is attached to at least one rim of said axis. In case that the trigger finger squeezes the safety-catch in the movement defined above, the aforementioned protruded pin member (303*a*) is pointed towards the trigger guard to a certain position and is further completely accommodated within a groove (603) located in the trigger guard.

Reference is made now to FIGS. 1-5, 6A and 6B, presenting a handgun 100 having the safety mechanism according to the present invention. The safety mechanism generally comprising the two main assemblies:

(I) a lock ring assembly (300) having (i) a ring (3) having an inner diameter of a predetermined width of 15 to 19 mm, designed to accommodate the trigger finger of an adult; and (ii) at least two safety pivotal latches (301, 302) connected with the ring (3) inside portion. The latches are maneuverable from an initial minimum diameter (Mn) configuration to a maximum diameter (Mx) configuration. The maximum diameter configuration is equal or lower than the external diameter of the inserted trigger finger. Furthermore the maximum diameter Mx is bigger then a toddlers finger's diameter. Whilst all said latches (301, 302) are simultaneously provided in their Mx maximal configuration, the operation of the trigger (1) is enabled, such that the operation is only performed by adults.

(II) a box assembly (6) interconnecting the ring assembly (300) with a trigger (1). The box assembly adapted to accommodate the ring assembly (300), has (i) a body having at least one locking element; and, (ii) a box cover (8), entrapping the lock ring assembly to the trigger guard (2).

A lock ring assembly (300), which is designed to be attached to the handgun's trigger (1) is entrapped inside the aforementioned box assembly. This lock assembly moves when pressed by the trigger finger together with the trigger (1) along a predetermined course inside the box assembly (6), to enable the shot.

The lock ring assembly (300) comprises a ring (3) and a ring cover. Additionally and most importantly, said assembly comprises one or more safety latches (see for example two safety latches 301 and 302). Said latches (301, 302) are placed in the groove cuts in the ring (3). Lock ring assembly (300), and may additionally comprise a ring cover which is adapted to lock the ring assembly together. The ring cover which fits on the trigger (1) by its trigger channel, has grooves cut to fit the edge of one or more safety elements defined below, and thus allows it to be locked.

The box assembly (6) has at least two parts: a body (6), which contains one or more, locking elements (7*a* and 7*b*—in a single action handguns, or 601 and 602—in double action handguns). In addition, said box assembly comprises an adjusting grip triangle and box cover (8).

The box assembly (6) is designed to latch on the trigger guard (2) by sliding on it from the left side of the gun, and adjusting its grip to the trigger guard by fastening the triangle by turning a screw clockwise.

The box cover (8) designed to clamp the box by one or more lock screws that are inserted through it, to lock onto their threaded locations on the box (6). Thus, locking the box assembly on the handgun's trigger guard (2).

Figure 6A:
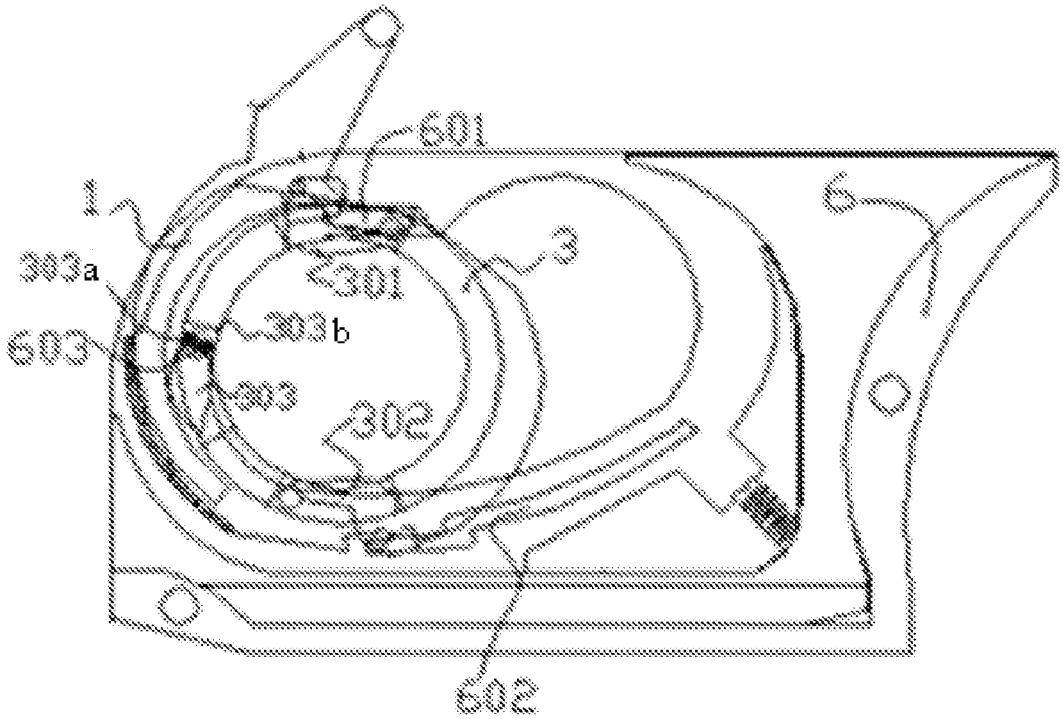
FIG. 6*b* shows the handgun in the 1$^{st}$ step and FIG. 6*a* shows the handgun in firing position.
Figure 6B:
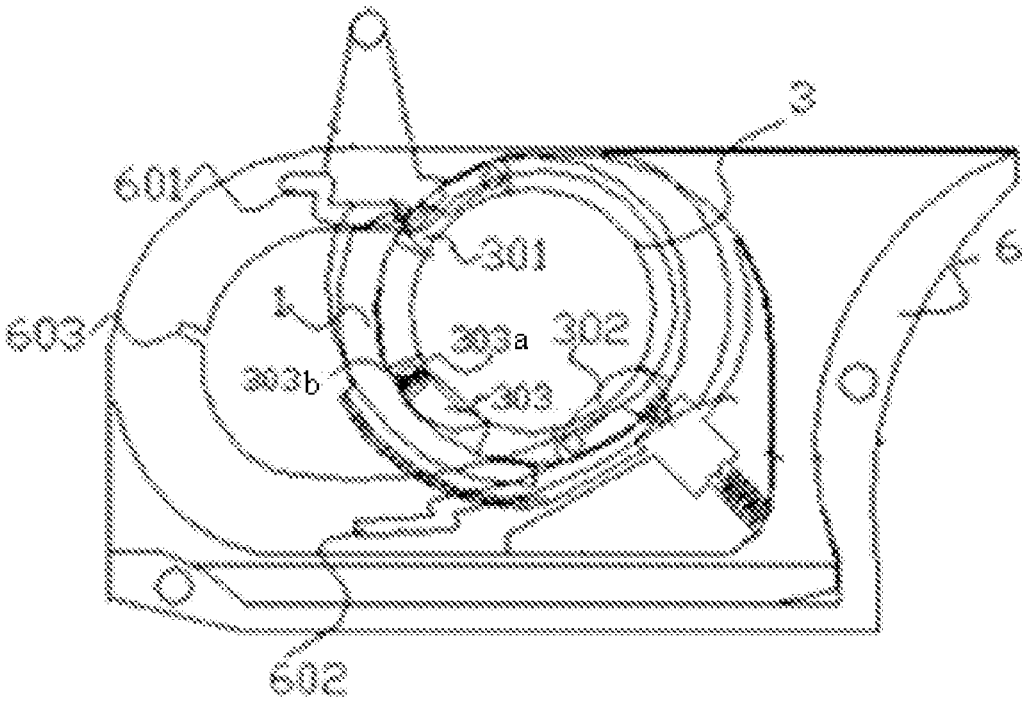

FIGS. 6*a* and 6*b* present the safety mechanism according to one embodiment of the present invention, especially adapted for handguns having a double action mechanism. Those figures reflect that the ring assembly is useful as measuring tool and the box assembly is an effective lock, both interact with each other as a matching set of a Key and its Pin-Lock.

In order to shoot the handgun, the user has no other choice but to insert his trigger finger into the circle of a lock ring (3). Otherwise the user could not pull the trigger (1), which is attached to the lock ring assembly (300), backwards (i), thus bringing the trigger to its firing position. By doing so, the finger circumference pushes all the safety latches (301, 302) to outward direction through the grooved lock ring, thereby putting them ready in position to perform their locking functions as preceded.

Only in use of double action handguns, the trigger has to be pulled backwards to complete the first cocking action. Therefore, the locking mechanism is not permitted to lock the trigger to the box before the first action is completed, because it would be rather useful at load the gun with the said finger resting on the trigger. In this step the handgun is loaded and locked into the aforementioned first action position. Only an adult whose trigger finger has a circumference of above 17 mm may push all the safety latches (301) and (302) far enough to perform the act of separating the locking ties between the locking elements (601) and (602), and thus releasing the trigger to perform the shot. All the latches (301, 302) are to be simultaneously pressed (i.e. to be in their Mx maximal configuration), in order for the operation of the trigger (1) is enabled. Due to that, the operation of shooting is enabled to be performed only by adults and not by toddlers.

If the adult shooter chooses to shoot, he has to complete the second step of the double action mechanism as defined above, in order to fire the handgun. In said step, the shooter shall find that the safety latches (301) and (302) are acting as lock pins, somewhat similar to the door lock mechanism. Thus, while the safety latches are being pushed by the shooter's trigger finger to reach their predetermined locations, the safety latches enable the release of the locking elements (601) and (602). The release of the locking elements is obtained by lifting the tooth, against the pressure of its spring, away from the ring's groove, and hence pushes the locking element out of the groove in the ring corner. Thus, unlocking ring (3) facilitated the movement of the trigger towards a firing position.

In another preferred embodiment of the present invention, the above mentioned safety mechanism additionally comprises a safety-catch. The safety mechanism comprises a lock ring assembly (300) and a box assembly (6) adapted to accommodate said ring assembly. The lock ring assembly (300) comprises inter alia a trigger in communication with the fire mechanism of the handgun; a ring having a inner diameter of about 15 to 19 mm, and most preferably 17 mm, designed to accommodate the trigger finger of an adult; one or more safety latches, and preferably two latches; and a safety-catch characterized by either elliptical or polygonal shape. The box assembly is adapted to accommodate the ring assembly. The box assembly comprises inter alia a body having one or more locking elements (7*a* and 7*b*—in a single action handguns, or 601 and 602—in double action handguns), preferably two such elements, and a box cover, entrapping the lock ring assembly to the trigger guard. The aforementioned safety mechanism is especially designed to enable the shooting only whenever the trigger finger is touching all the safety latches, wherein all said safety latches are in communication with all said locking elements. The safety-catch (303) can additionally comprise at least one groove cut (303*b*), designed to accommodate the trigger finger of an adult squeezing the trigger (1). The safety catch is connected to the ring (3) by a protruding pin member (303*a*). The groove cut (303*b*) is adapted to accommodate the pin member (303*a*) in a situation the safety-catch is effectively pressed by means of the digital pulp of the trigger finger. Furthermore, the safety catch is adapted to enable the shooting only whenever a trigger finger of an adult is pressing both the safety latches (301, 302) and the safety catch (303) simultaneously.

According to each of the above described embodiments, at least one safety-catch (303) is pushed by the trigger finger's circumference into the ring (3). This pushing motion also turns it around its axis. Thus, it changes the position of a square tip, also referred herein after to the term 'pin member' (303*a*) appended to said axis, to be in stationed in a match position to a groove located in the body cover. Thus, the trigger is allowed to be squeezed backward—i.e., toward a shooting position. It is acknowledged hereinafter that extra precautions are taken to prevent a toddler from using a wide stick as an adult trigger finger in order to facilitate the forbidden shoot. In this manner it is also acknowledged that attention was given to the fact that clever toddlers are capable of inserting an element thicker than their finger, in order to squeeze the trigger. Therefore, the present invention presents a novel and practical approach wherein said safety-catch (303) is designed to be inserted in its ring's groove beyond the internal circumference of the lock ring (3). Only a human finger having a digital pulp as defined above can cause this squeezing action. This is due to the fact that when pushing the trigger finger inside the circumference of the lock ring, the digital pulp is elastic enough to protrudes beyond the diameter of the ring, to a short distance of about one millimeter.

According to another embodiment of the present invention, said safety-catch is an ingredient of the ring assembly (300), and located on the back location on the ring, facing the trigger. Ring (3) further comprising a groove cut is adapted to (i) fit the safety-catch (303) by means of size and shape, thus enabling said safety-catch to penetrate the width of said ring; and, (ii) similarly to provide the pin member (303*a*) to spin along the axis and to be accommodate completely in the groove (603). Only when said pin member (303*a*) is in the groove, (603 see FIGS. 6*a*, 6*b*), the trigger is capable to be squeezed and the safe shooting is enabled.

According to another embodiment of the present invention, said safety latch (303) is located on the trigger. According to this embodiment, a groove cut adapted to (i) fit the safety-catch (303) by means of size and shape, thus enabling said safety-catch to penetrate the width of said trigger; and similarly (ii) to provide the pin member (303*a*) to spin along the axis and to be accommodated completely in the groove (603). In this embodiment, the mechanism of said safety-catch is separate from the safety mechanism as defined above and may stand alone as a safety mechanism for a handgun.

As pointed out before, the average diameter of the trigger finger of an adult is about 17 mm wherein the average diameter in toddlers is in the range of 13 to 14 mm, having the aforementioned unfit Pin-Lock key, because they are not able to move the safety latches (301, 302) and safety-catch (303) at one. A toddler may be able to load and perform the first action, but on the second action the lock ring assembly will remain latched to the box, by at least one of the locking elements and thus shall not allow the trigger to move on to its predetermined firing position.

Reference is made again to FIGS. 1-6 presenting a safety mechanism according to the present invention, especially adapted to a single action and a double action handgun. This safety mechanism mainly comprises a box assembly (6) and a lock ring assembly (300). The box (6) interconnects the ring assembly (300) with the trigger (1). The box contains the lock and one or more ducts. It is additionally comprises an adjusting grip triangle and a box cover. The box (6) is designed to latch on the trigger guard (2) by sliding on it from the left side of the gun, and adjusting its grip to the trigger guard.

The box cover (8) is adapted to attach to the box by one or more especially designed lock screws that are inserted through it to lock unto their threaded locations on body (6). Thus, to lock the box assembly on the handgun's trigger guard (2). This box contains the lock ring assembly (300) that is designed to be attached to the handgun's trigger (1) and move, when an adult's trigger finger is pressing the trigger, on a predetermined course inside the box, to facilitate the shot.

The lock ring assembly (300) comprises a ring (3), a ring cover that contains in-between themselves the one or more safety latches, here (301) and (302) connected within the ring (3) inside portion. In another preferred embodiment of the present invention, the lock ring assembly (300) additionally comprise at least one safety-catch (303).

In order to shoot, the adult user has no choice but to insert his trigger finger into the inner circle of the lock ring assembly (300), otherwise he could not pull the trigger (1) backwards. I.e. (i), bringing the trigger into a firing position. By doing so, the finger's circumference is pushing the one or more safety latches (301), (302) and the safety-catch (303) in outwardly direction through the lock ring, thus enabling their unlock abilities.

When the handgun is ready to shoot, an adult only can push all the safety latches and safety catch far enough to perform the act of separating the locking ties between the locking elements (7*a*) and (7*b*) of the ring box, and thus to release the trigger to facilitate the shot. In case an adult chooses to fire the handgun, he shall find that the safety latches are acting as a lock pins, somewhat similar to a door pin lock. Only when all said latches and catch are effectively pushed, the lock is released and firing of the handgun is enabled.

It is also acknowledged that the mechanism of the safety-catch (303) in the single action handgun is similar to the one defined above for double action handguns.

According to yet another embodiment of the present invention, an electronic mechanism for the safety mechanism is presented. The electronic embodiment comprises a box assembly, a lock ring assembly and the electronic circuit assembly. This electronic circuit assembly has power supply from a disposable battery or any other effective, light weight means.

According to another embodiment, the aforementioned electronic safety mechanism incorporated in either single or double action handgun. In principle, the control box has two parts: the body and the box cover. The body contains the locking servo, locking micro-switch and one or more grip screws. The box cover has an opening adapted to accommodate the trigger finger and grip-screw holes, for grip screws.

The body (6) is adapted to latch on the trigger guard (2) by sliding on it from the left side of the handgun and adjusting its grip to the trigger guard by fastening the grip screws through the cover into their threads in the box. Those screws are of the lock screw type, which requires a special fit screwdriver in order to open or close said screws. Thus, the screws are adapted according to the present invention to lock the box onto the trigger guard (2) of the handgun.

The box (6) contains the lock ring assembly (300) that is adapted to be attached to the handgun's trigger (1) on a designed course inside the box, and to enable the shot. The ring assembly is composed of a ring (3), a ring cover that contains in-between themselves at least two safety latches (301), (302). Those safety latches act in the manner similar to a modern door lock.

The embodiment of an electronic version of the safety mechanism defined in the present invention operates by using the lock ring assembly (300) as a measuring tool, adapted to indicate if the user of the handgun is an adult. More specifically, it is adapted to indicate whether the finger trigger (i.e., the key) is of an adult. The box assembly acts as the lock of the safety mechanism. Both above defined assemblies interact simultaneously as a lock and key set. The shooting sequence in this embodiment is much similar to the one defined above. Nevertheless, a few adaptations are acknowledged: the user inserts his trigger finger into the inner circle of the ring (3). Avoiding this will disable the trigger to be pulled backwards to the firing position. By doing the same, the trigger finger pushes the safety latches in an outward direction through the ring, thus enabling the unlocking step.

At the time the handgun is ready to shoot, only an adult who has a trigger finger with circumference diameter higher than about 17 mm, can push the safety latches far enough to perform the act of connecting the micro-switch and thus to close the electric circuit at the ring assembly (300) to the servo lock, and thus release the trigger to enable the shoot.

When an adult chooses to fire the handgun, all the safety locks are simultaneously pressed to activate one or more micro-switches that are lined up on the circuit. This special arrangement provides a direct current to flow from the positive pole of a battery to the negative pole of the servo and to the negative pole of the battery. The servo's electromagnet pulls the lock tongue into the body and releases the same from the trigger to enable the shoot.

According to another preferred embodiment of the present invention, an additional and external lock is used to provide extra safety to the handgun.

According to another embodiment of the present inventions the safety-catch comprises: (i) a trigger in communication with the fire mechanism of said handgun; (ii) a catch having means to swing through an opening in the trigger; and (iii) a trigger guard having a groove, designed to accommodate the safety latch whenever the trigger is twisted by the digital pulp of the trigger finger.

What is claimed is:

1. A safety mechanism for handgun (100) useful for preventing shooting said handgun by toddlers, comprising: a box assembly (6) accommodating a lock ring assembly (300); and a box cover (8), entrapping said box assembly to a trigger guard (2);

said box assembly (6) interconnecting said ring assembly (300) with a trigger (1); said lock ring assembly (300) comprising: (i) a ring (3), and (ii) at least two pivotal latches (301, 302) connected with said ring (3) inside portion; said latches are maneuverable from an initial minimum diameter (Mn) configuration to a maximum diameter (Mx) configuration; said maximum diameter configuration is being equal or lower than the external diameter of the inserted trigger finger; said maximum diameter Mx is bigger then a toddlers finger's diameter;

whilst all said latches (301, 302) are simultaneously provided in their said Mx maximal configuration, the operation of said trigger (1) is enabled, such that said operation is only performed by adults.

2. The safety mechanism according to claim 1, wherein said lock ring assembly (300) having an inner diameter of 15 to 19 mm, designed to match the width of the trigger finger of an adult squeezing said trigger.

3. The safety mechanism according to claim 2, having electrical communication between the latch and the locking element, comprising the lock ring assembly, the box assembly and an electronic circuit assembly.

4. The safety mechanism according to claim 3, wherein the electronic circuit assembly comprising a locking servo, locking micro-switches and disposable power supply.

5. The safety mechanism according to claim 2 specially adapted to a double action handguns comprising: at least two safety latch (301, 302) having means to move inside a groove cuts in said ring (3); adapted to enable the shooting only whenever a trigger finger of an adult is pressing all said safety latches simultaneously.

6. The safety mechanism according to claim 1, having a mechanical communication between said latches (302, 301) and locking elements (7*a*, 7*b*); wherein said locking elements (7*a*, 7*b*) are pressed, enabling said trigger (1) to be squeezed so as said shooting is facilitated.

7. The safety mechanism according to claim 1, additionally comprising a safety-catch (303) having at least one groove cut (303*b*), designed to accommodate the trigger finger of an adult squeezing said trigger (1); said safety catch is connected to said ring (3) by a protruding pin member (303*a*); said groove cut (303*b*) is adapted to accommodate said pin member (303*a*) in a situation said safety-catch is effectively pressed by means of the digital pulp of the trigger finger; said safety catch is adapted to enable the shooting only whenever a trigger finger of an adult is pressing both said safety latches (301, 302) and said safety catch (303) simultaneously.

8. The safety mechanism according to claim 1, useful for rifles, weapons, shot guns, revolvers and pistols.

9. The safety mechanism according to claim 1, additionally comprising means to accommodate external lock.

10. A method to prevent toddlers to shot a handgun comprising the safety mechanism as defined in claim 1 comprising; matching the circumference of the trigger finger to have diameter higher a value of 15 to 19 mm so in case of toddlers squeezing the trigger, the shot is prohibited, and alternatively, in case adults are using said handgun, shooting is enabled.

11. The method according to claim 10, wherein said method is especially useful for preventing shooting of a double action handgun having a mainspring by toddlers; said method additionally comprising steps of: a) inserting the trigger finger into the trigger guard of said handgun; b) pressing simultaneously all said safety latches by said trigger finger; c) compressing said mainspring of said handgun by either cocking the hammer or pulling the trigger; and d) squeezing said trigger by said trigger finger and enabling the shoot.

12. The method according to claim 10, wherein said method is especially adapted to prevent shooting of a single action handgun having a mainspring by toddlers; said method additionally comprising steps of: a) compressing said mainspring of said handgun; b) inserting the trigger finger into the trigger guard of said handgun; c) pressing simultaneously all said safety latches by said trigger finger; and d) squeezing said trigger by said trigger finger and enabling the shoot.

13. The method according to claim 10 for shooting a handgun comprising a safety-catch having at least one groove cut (303*b*), designed to accommodate the trigger finger of an adult squeezing said trigger (1); said safety catch is connected to said ring (3) by a protruding pin member (303*a*); said method additionally comprising steps of: squeezing said trigger by the digital pulp of said trigger finger such that said safety-catch is sufficiently pressed enough inside said groove cut, thus enabling said pin member to fit inside a groove either in the trigger guard or in the box cover.

14. The method according to claim 10, wherein said method is especially useful for preventing toddlers from shooting a double action handgun of the type having a mainspring, an electronic circuit assembly comprising a locking servo, locking micro-switches and disposable power supply; said method additionally comprising steps of: a) inserting the trigger finger into the trigger guard of said handgun; b) pressing simultaneously all said micro-switches by said trigger finger such that a servo's electromagnet is pulling a lock tongue thereby enabling the trigger to move backwards; c) compressing said mainspring of said handgun by either cocking the hammer or pulling said trigger; and d) squeezing said trigger by said trigger finger and enabling the shot.

15. The method according to claim 10, wherein said method is especially useful for preventing toddlers from shooting a single action handgun of the type having a mainspring, an electronic circuit assembly comprising a locking servo, locking micro-switches and disposable power supply; said method additionally comprising steps of: a) compressing said mainspring of said handgun; b) inserting the trigger finger into the trigger guard of said handgun such that a servo's electromagnet is pulling a lock tongue thereby enabling the trigger to move backwards; and c) squeezing said trigger by said trigger finger and enabling the shot.

* * * * *